United States Patent [19]

Coe

[11] Patent Number: 4,710,775

[45] Date of Patent: Dec. 1, 1987

[54] PARASITICALLY COUPLED, COMPLEMENTARY SLOT-DIPOLE ANTENNA ELEMENT

[75] Inventor: Richard J. Coe, Auburn, Wash.

[73] Assignee: The Boeing Company, Seattle, Wash.

[21] Appl. No.: 781,650

[22] Filed: Sep. 30, 1985

[51] Int. Cl.[4] ..... H01Q 21/00

[52] U.S. Cl. ..... 343/727; 343/767; 343/793

[58] Field of Search ..... 343/725, 727, 730, 767, 343/793, 797

[56] References Cited

U.S. PATENT DOCUMENTS

| | | | |
|---|---|---|---|
| 2,946,055 | 12/1960 | Faflick | 343/727 |
| 3,340,534 | 9/1967 | Fee | 343/728 |
| 3,382,501 | 9/1965 | Fee | 343/728 |
| 3,710,340 | 1/1973 | Mayes | 343/725 |
| 3,771,158 | 11/1973 | Hatcher | 343/728 |
| 3,778,838 | 12/1973 | Clavin | 343/727 |
| 4,443,802 | 4/1984 | Mayes | 343/729 |
| 4,571,592 | 2/1986 | Justice | 343/767 |
| 4,587,524 | 5/1986 | Hall | 343/767 |

FOREIGN PATENT DOCUMENTS

| | | | |
|---|---|---|---|
| 17530 | 10/1980 | European Pat. Off. | 343/727 |

*Primary Examiner*—William L. Sikes
*Assistant Examiner*—Robert E. Wise
*Attorney, Agent, or Firm*—Finnegan, Henderson, Farabow, Garrett & Dunner

[57] ABSTRACT

A parasitically coupled, complementary slot dipole antenna element includes a driven, cavity-backed slot antenna element and a parasitic dipole element transverse to the slot of the cavity-backed slot antenna element. The cavity-backed slot and parasitic dipole antenna elements resonate at about the center frequency of the excitation signals supplied to the cavity-backed slot antenna element in order to generate a relatively symmetrical electromagnetic signature and an increased bandwidth.

32 Claims, 12 Drawing Figures

PARASITICALLY COUPLED, COMPLEMENTARY SLOT-DIPOLE ANTENNA ELEMENT

BACKGROUND OF THE INVENTION

The present invention relates to the field of slot-dipole antenna elements, and in particular to the use of such antenna elements in arrays for aerospace applications.

Antennas are required for many aerospace applications, such as electronically scanned arrays for aircraft or satellite radar and communications systems or missile tracking, telemetry, and seeker antennas. The radiating elements used in such applications must conform to the surface of the vehicle carrying the antennas and must be both lightweight and capable of being manufactured relatively inexpensively and accurately using printed circuit technology.

Modern surveillance radars also require a wide signal bandwidth for scanning. The pattern beamwidth appropriate for wide angle scanning may also require dual orthogonal senses of polarization. Some commonly-used printed circuit elements for conformal array applications include a microstrip patch, a printed circuit dipole, and stripline-fed, cavity-backed slots. These elements usually have a narrow bandwidth, typically around three percent (3%), which limits their utility. Other commonly used radiating apertures for antenna arrays consist of metallic rectangular or circular waveguides or cavities. These waveguides or cavities, however, are expensive to manufacture and are prohibitively heavy for airborne applications.

OBJECTS AND SUMMARY OF THE INVENTIONS

One object of this invention is an antenna system which can conform to the surface of an airborne vehicle.

Another object of this invention is an antenna system which can be used in a lightweight and relatively inexpensively manufactured antenna array for aerospace application.

Yet another object of this invention is an antenna system which can be manufactured with printed circuit technology relatively inexpensively and accurately.

A further object of this invention is an antenna system that provides a relatively symmetrical electromagnetic signature and an increased bandwidth.

Additional objects and advantages of this invention will be set forth in the following description of the invention or will be obvious either from that description or from the practice of the invention.

The objects and advantages of this invention may be realized and obtained by the apparatus pointed out in the appended claims. The complementary slot-dipole antenna element of this invention overcomes the problems of the prior art and achieves the objects listed above since it is amenable to printed circuit design and manufacture, has dimensions and patterns suitable for phased arrays with wide angle scan requirements, and has a wide frequency bandwidth, typically about thirty percent (30%). The dipole antenna system of this invention may also be constructed in either a single or dual orthogonal sense linear polarization configuration and used as the components of an antenna array.

Specifically, to achieve the objects and in accordance with the purpose of the invention, as embodied and broadly described, the antenna element of this invention is coupled to a source of excitation signals having a center frequency and comprises a driven cavity-backed slot antenna element coupled to the source of excitation signals, the cavity-backed slot antenna element having a first axis transverse to the longitudinal axis of the slot. The antenna element also comprises a parasitic dipole element displaced a predetermined distance from the cavity-backed slot antenna element and having a longitudinal axis parallel to the first axis of the cavity-backed slot antenna. The antenna element of this invention produces a relatively symmetrical electromagnetic signature and provides an increased bandwidth.

The accompanying drawings, which are incorporated in and constitute a part of the specification, illustrate an embodiment of this invention and, together with the description, explain the principles of the invention.

BRIEF DESCRIPTION OF THE DRAWINGS

FIG. 8 is a more detailed diagram of an array of slot-dipole antenna elements similar to those shown in FIG. 6A.

DESCRIPTION OF THE PREFERRED EMBODIMENT

Reference will now be made in detail to a preferred embodiment of this invention which is illustrated in the accompanying drawings.

Figure 1:
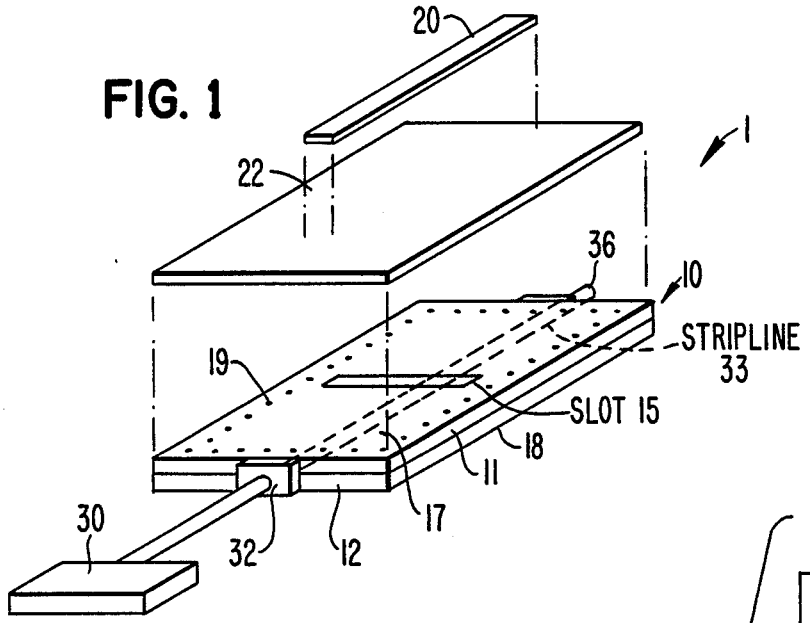
FIG. 1 is an exploded, schematic view of one embodiment of a parasitically coupled, complementary slot-dipole antenna element of this invention.

FIG. 1 shows an exploded view of a complementary slot-dipole antenna element 1 of this invention having a single sense linear polarization configuration. In FIG. 1, antenna element 1 is coupled to a source of excitation signals 30 via stripline feed 32. Source 30 can be an isolated source, for example, or a feed distribution network if element 1 is part of an array of elements.

Antenna element 1 also includes a driven cavity-backed slot antenna element 10 coupled to source 30. For ease of manufacturing, cavity-backed slot antenna element 10 is preferably dielectric-filled. For example, antenna element 10 may include two layers 11 and 12 of teflon-glass substrate, each approximately 0.3 inches thick. Element 10, however, could also be air-filled, although such an element is more difficult to manufacture.

In FIG. 1, the cavity of element 10 includes upper and lower surfaces 17 and 18, respectively, and a plurality of plated holes 19 arranged in a rectangular pattern near the periphery of antenna element 10. Surfaces 17 and 18, and holes 19 thereby form a six-sided cavity. Persons of ordinary skill will recognize that there are other ways of forming a cavity and other techniques, besides plated holes, for connecting upper and lower surfaces 17 and 18.

Slot 15 is formed in upper surface 17 of antenna element 10 and has a longitudinal axis parallel to the longer dimension of the slot. That longitudinal axis of slot 15 is transverse to a first axis of cavity-backed slot antenna element 10 which, in FIG. 1, is parallel to stripline a 33.

The excitation signals from source 30 pass through stripline 33 and excite slot 15 of the cavity-backed, slot antenna element 10. Slot 15 excites the cavity. As shown in FIG. 1, stripline 33 passes from stripline feed 32 to stripline feed 36 between layers 11 and 12. The present invention is not limited to the use of a stripline feed, and persons of ordinary skill will recognize other methods of exciting slot 15.

In a preferred printed circuit board embodiment of this invention, a bottom layer 12 of printed circuit board material would have as its lower surface 18 an unetched copper sheet, and its upper surface would include a copper sheet etched so that only stripline 33 remained. Top layer 11 of printed circuit board material would have its bottom layer completely etched and its top layer 17 would include a copper sheet etched only at slot 15. Top and bottom layers 11 and 12 would then be fastened together, holes 19 would be drilled between surfaces 17 and 18 and then those holes would be plated through. Persons of ordinary skill will recognize other methods of printed circuit board manufacture, such as forming the stripline on the bottom surface of layer 11 or the use of shorting screws instead of plated through holes.

As shown in FIG. 1, the complementary slot-dipole antenna element of this invention includes parasitic dipole element 20 having a longitudinal axis aligned with the first axis of cavity-backed slot antenna element 10. Dipole element 20 is selected so that the combination of elements 20 and 10 resonate at approximately the center frequency of the excitation signals. In a printed circuit board embodiment of the complementary slot-dipole of this invention, parasitic dipole 20 would include a metallic strip etched on the top layer of a thin printed circuit board whose bottom layer had been completely etched away.

Parasitic dipole element 20 is also displaced a predetermined distance above cavity-backed slot antenna element 10. As shown in FIG. 1, spacer sheet 22 holds parasitic dipole 20 that predetermined distance from cavity-backed slot antenna 10. Spacer sheet 22 could include a foam layer as well as a layer of printed circuit board material, but preferably spacer sheet 22 includes a honeycomb material for added flexibility. Of course, other means for separating the antenna elements besides spacer sheet 22 may be used, as persons of ordinary skill will recognize.

The electric field of slot 15 is parallel to the axis of parasitic dipole element 20. The result is that both elements are coupled and will radiate when either is driven. The cavity in antenna element 10 ensures that the fields produced by slot 15 and dipole element 20 only radiate in one direction.

In the operation of the cavity-backed slot dipole antenna element of this invention, in response to the excitation signals from source 30, stripline 33 generates a current in antenna element 10. Slot 15, however, interrupts the return current, thereby generating a voltage across slot 15 which then radiates as a magnetic source. The fields in slot 15 induce a voltage in the parasitic dipole element 10 causing it to radiate as an electric source. The electric and magnetic fields bear a special relationship to each other which is defined by the duality principle. That relationship is exploited in this invention to obtain a relatively symmetrical antenna pattern and to increase the bandwidth approximately tenfold over that of the individual elements themselves. When the separation between the slot and dipole is properly chosen, for example, by observing the pattern shape and symmetry as a function of spacing either empirically or by computer model, the phases of the electric and magnetic currents cause the composite far field pattern to become independent of azimuth angle, and therefore omnidirectional, whereas in the direction of their axes, the individual azimuth patterns of cavity 15 and dipole element 20 exhibit zeroes.

Figure 2A:
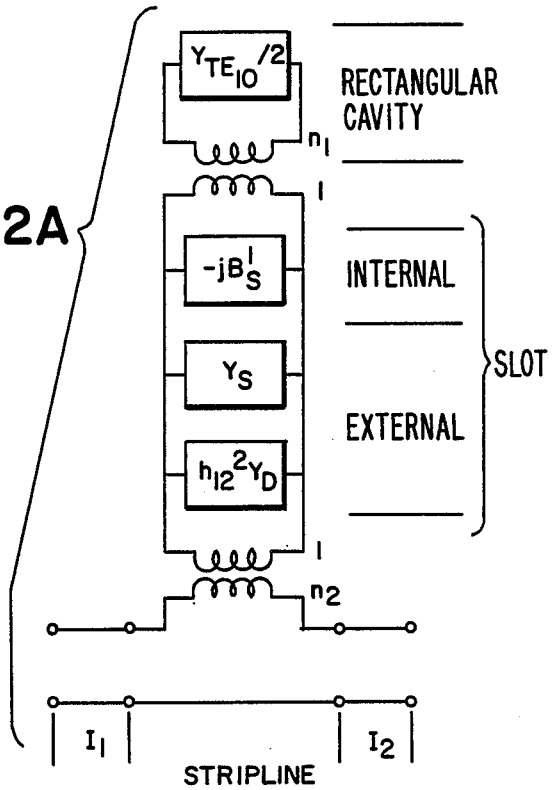
FIG. 2A is an equivalent circuit diagram for the slot-dipole antenna element in FIG. 1.

For this same spacing and selection of slot and dipole dimensions, the admittances of parasitic dipole element 10 and slot 15 combine so that the susceptance variations tend to cancel over a frequency band centered around resonance, i.e., the center frequency of the excitations signals source 30. An equivalent circuit in FIG. 2A shows the slot admittance $Y_s$, in parallel with an admittance $h_{12}^2Y_D$, where $Y_D$ is the dipole admittance and $h_{12}$ is the coupling factor.

Figure 2B:
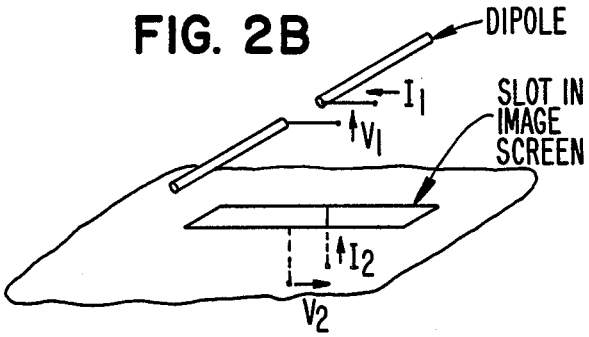
FIGS. 2B and 2C are diagrams showing circuit relationships that form the basis for impedance calculations for the slot-dipole antenna element in FIG. 1.

FIG. 2B shows an analytic impedance model for a stripline fed cavity-backed slot and a perfectly conducting image plane which includes a parasitic dipole element. The slot is center fed with a terminal voltage $V_2$ and terminal current $I_2$. The voltage and current on the parasitic dipole are $V_1$ and $I_1$, respectively. Equation 1 shows the relationship between the terminal quantities in terms of the hybrid parameters in FIG. 2A:

$$V_1 = h_{11}I_1 + h_{12}V_2$$
$$I_2 = h_{21}I_1 + h_{22}V_2 \quad (1)$$

The parameter $h_{11}$ is the input impedance of the dipole when the slot is short circuited.

$$h_{11} = \left.\frac{V_1}{I_1}\right|_{V_2 = 0} \quad (2)$$

Figure 2C:
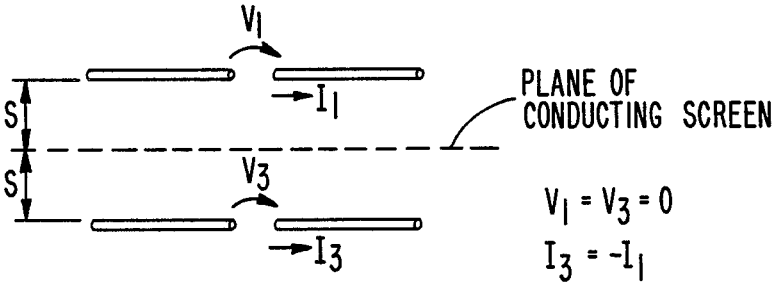

As FIG. 2C shows, $h_{11}$ is the input impedance of a dipole in the presence of its image. By using image theory, the network equations for the dipole and its image, which has voltage and current $V_3$ and $I_3$, respectively, yields the following equation 3 for $h_{11}$:

$$h_{11} = Z_D = \left.\frac{V_1}{I_1}\right|_{V_2 = 0} = Z_{11} - Z_{13} \quad (3)$$

$Z_{11}$ is the self impedance of an isolated dipole and $Z_{13}$ is the mutual impedance between two sets of dipole separated by a distance 2S, where S is the predetermined distance between parasitic dipole element 20 and cavity-backed slot antenna element 10. Both $Z_{11}$ and $Z_{12}$ can be determined from known solutions.

The input admittance of the slot with the dipole open circuited is the parameter $h_{22}$, where $$h_{22} = Y_S = \left.\frac{I_2}{V_2}\right|_{I_1 = 0} \tag{4}$$

The admittance of a slot in this analysis was obtained from variational expressions.

The transfer ratio $h_{12}$ and the current ratio $h_{21}$ are related by the principles of reciprocity, so $$h_{21} = -h_{12} \tag{5}$$

Therefore, only one of these parameters need be identified. The parameter $h_{21}$ is defined as the ratio of short circuit current in the slot to the dipole current. With a sinusoidal current distribution on the dipole and the magnetic current distribution, f(y), on the slot, the parameter $h_{21}$ is given by:

$$h_{21} = 2\int_0^{L_{S/2}} J_x(y)\,(f(y))dy, \tag{6}$$

$$J_x = \frac{-jS}{\pi r_0^2}\left(e^{-jkr_1} - \cos\frac{kL_D}{2}\right);$$

where $L_S$ is the length of the slot, $L_D$ is the length of the dipole,

S is the predetermined distance separating the slot and the dipole, and $r_0$ and $r_1$ are distances to the field point from the center and the end of the dipole, respectively.

With the expressions for $h_{11}$, $h_{12}$ and $h_{22}$, the admittance of the slot in the presence of the dipole may be obtained by solving equation (1) for the ratio $I_2/V_2$ which yields $$Y_{IN} = h_{22} - \frac{h_{12}\,h_{21}}{h_{11}} \tag{7}$$

Figure 3:
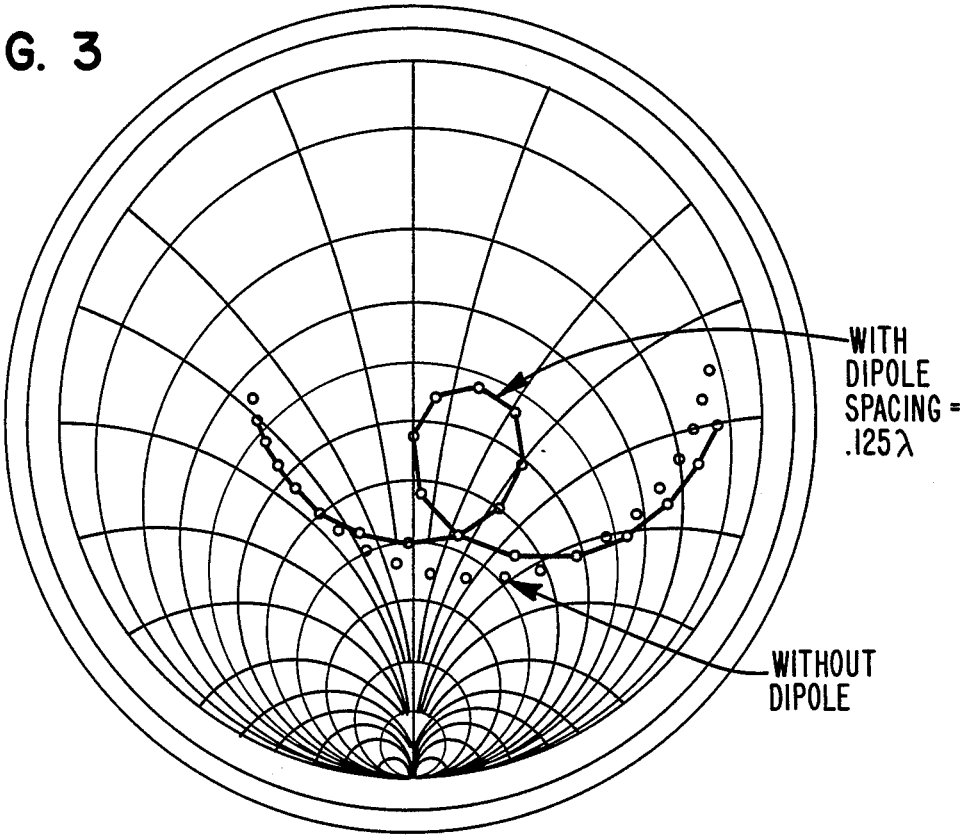
FIG. 3 is a Smith Chart demonstrating the calculated impedance of the slot-dipole antenna element in FIG. 1.

The impedance calculated from equation 7 has been plotted on the Smith Chart in FIG. 3. One of the curves shows the slot in absence of the dipole (i.e., S approaches infinity), and the second curve shows an impedance for S=0.125 times the wavelength at the center frequency. The second curve shows an increased bandwidth due to coupling between the resonant circuits.

As indicated previously, a crossed electrical dipole and magnetic dipole can be excited to produce a linearly polarized pattern which has pattern symmetry about the axis orthogonal to the plane of the electric and magnetic dipoles. The ideal situation, as the present invention indicates, is the use of a crossed dipole-slot, which must be an approximation because the slot and dipole may not be coplanar. The radiation pattern of a short x-directed electric dipole and a y-directed magnetic dipole, both lying in the x-y plane are $$\vec{E_d} = -j\omega\mu IL\frac{e^{-jKL}}{4\pi r}(\cos\theta\cos\phi\,\hat{\theta} - \sin\phi\,\hat{\theta}) \tag{8}$$

$$\vec{E} = \frac{-j\omega\epsilon I_m L}{30}\;\frac{e^{-jKr}}{4\pi r}(\cos\phi\,\hat{\theta} - \cos\theta\sin\phi\,\hat{\theta}),$$

where I is the electric current and $I_m$ is the magnetic current. To obtain azimuthal pattern symmetry, $I_m$ is chosen so that the factors in equation (8) preceding the cosine and sine coefficients are equal. This allows the normalized field patterns to be expressed by:

$$\vec{f_e} = \cos\theta\cos\phi\,\hat{\theta} - \sin\phi\,\hat{\phi} \tag{9}$$

$$\vec{f_m} = \cos\phi\,\hat{\theta} - \cos\theta\sin\phi\,\hat{\phi}.$$

The total field then is given by $$f^2 = (f_d + f_s)^2 = f_d^2 + f_s^2 + 2f_d f_s \tag{10}$$

Performing the indicated operations thus leads to the result that the linearly polarized pattern is independent of the angle $\phi$ and is thus rotationally symmetric about the Z axis.

$$\theta = \cos^{-1}(\sqrt{2} - 1) = 65.53^\circ \tag{11}$$

When the dipole and slot are not coplanar, the beamwidth decreases because of the displacement of phase sensors. The precise pattern can be calculated from the current distributions obtained from the impedance model.

An experimental model of the parasitically coupled, complementary slot-dipole antenna element of this invention was designed to test the theoretical analyses. The elements were chosen so they would resonate at 1.5 Ghz. Cavity-backed slot 10 was constructed from 2 layers of 0.3 inch thick teflon-glass substrate. The width of the cavity (8 cm) was chosen to propagate only in the $TE_{10}$ rectangular waveguide mode and the length of the slot was chosen to be 0.5 times the wavelength at the center frequency. The slot was located at the center of the cavity and not loaded by the cavity at the center frequency.

During testing, stripline feed 36 was terminated in a 50-ohm load and feed 32 was connected to a network analyzer. The impedance reference plane was chosen to be at the center of the slot. The measured impedance was thus the slot impedance plus 50 ohms.

Figure 4:
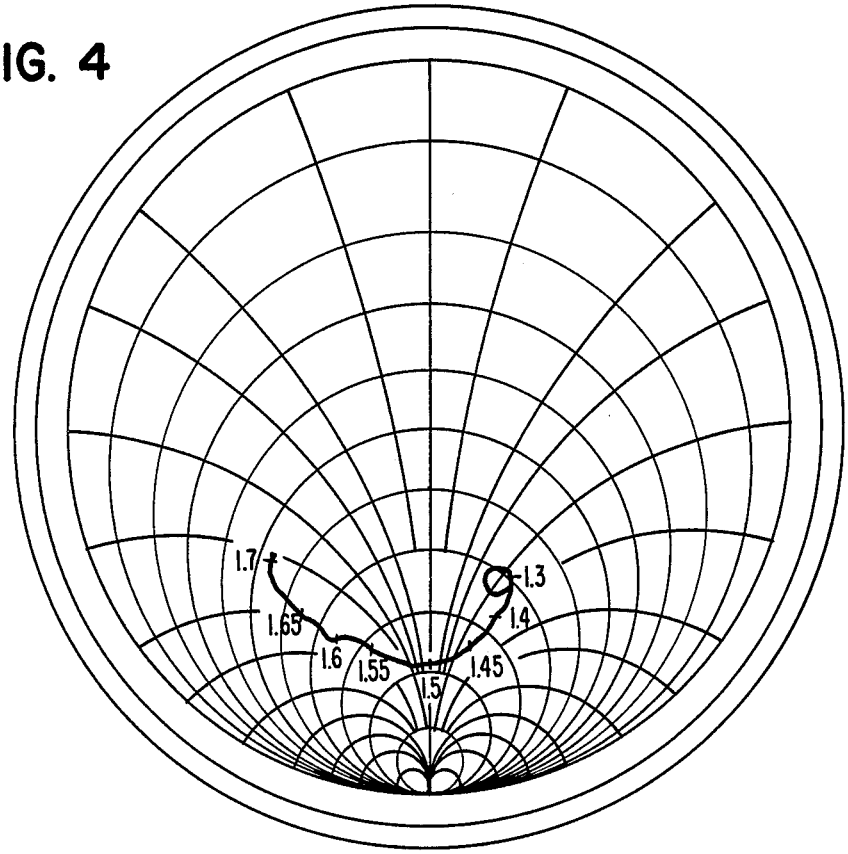
FIG. 4 is a Smith Chart showing the impedance of a cavity-backed slot antenna element in series with a 50 ohm termination.

The impedance of a 7.35 cm long cavity-backed slot terminated in 50-ohms is shown by the Smith Chart in FIG. 4. That impedance has narrowband behavior typical of an uncompensated slot.

Figure 5A:
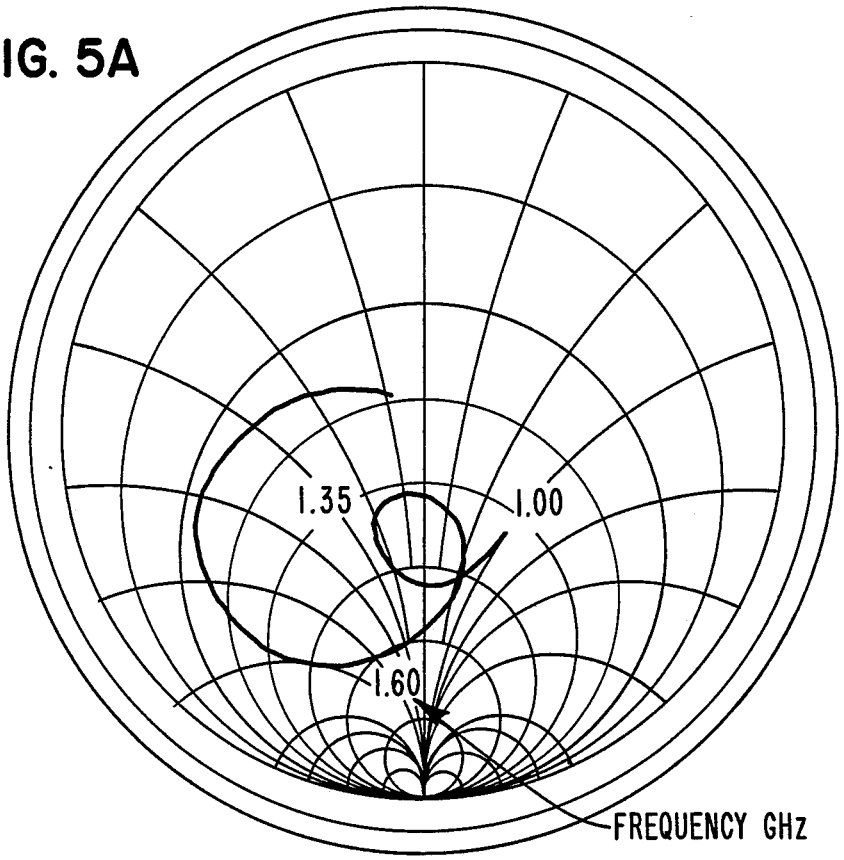
FIGS. 5A and 5B are Smith Charts showing the measured performance of the parasitically-coupled slot-dipole antenna element of FIG. 1.
Figure 5B:
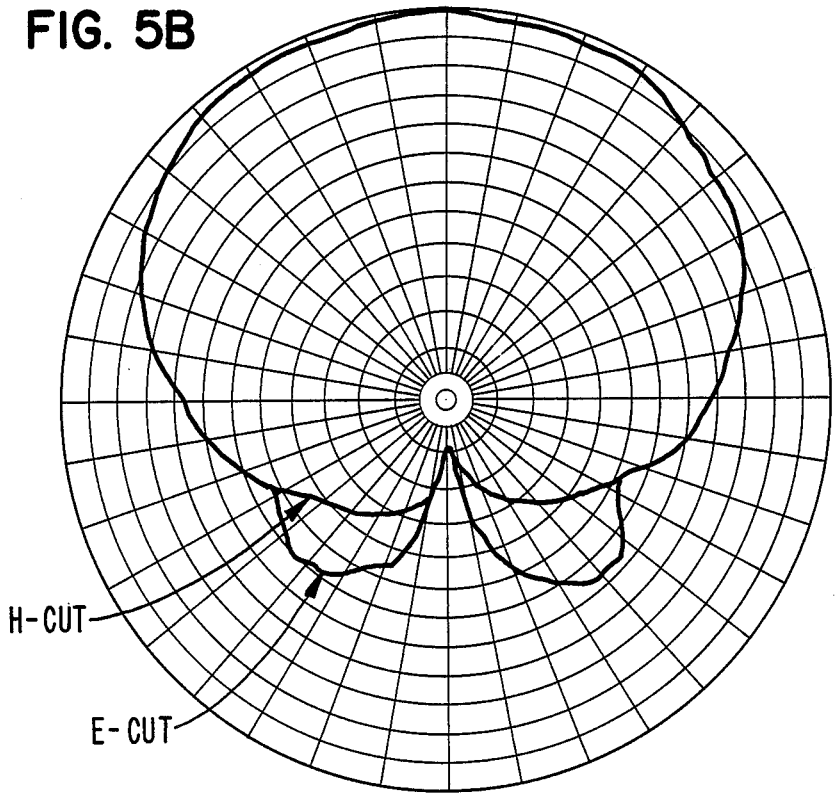

A parastic dipole 20 was then attached to foam spacers having various thicknesses. Pattern and impedance data were then obtained as a function of separation between slot and dipole. It was found that maximum impedance bandwidth occurred at a spacing of about 0.125 times the excitation signal center frequency wavelength. The corresponding impedance shown in the Smith Chart in FIG. 5A has an impedance bandwidth of about +15%. As the Smith Chart in FIG. 5B shows, the patterns have equal E and H plane beamwidths. The pattern measurements were made with a small ground plane which leads to diffraction around the ground plane that can be reduced if larger ground planes are used.

Figure 6A:
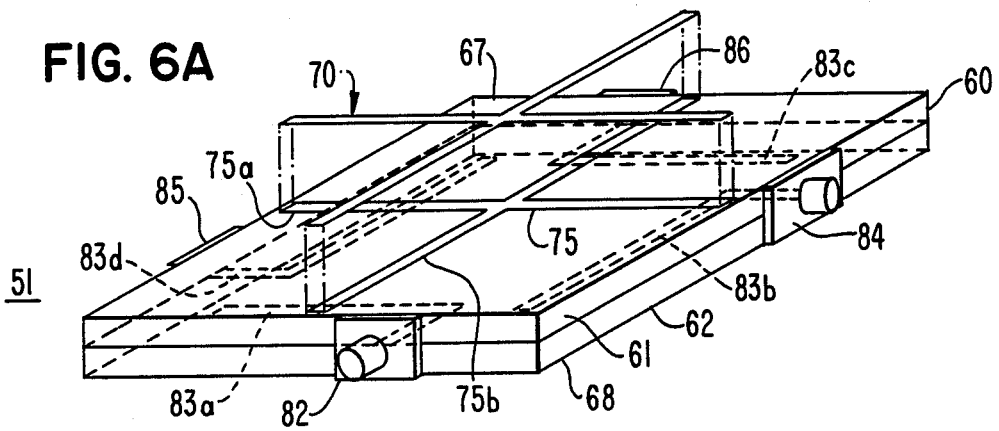
FIG. 6A is a schematic view of one embodiment of a dual orthogonal sense, parasitically-coupled complementary slot-dipole antenna element of this invention.

FIG. 6A shows an exploded view of a complementary slot-dipole antenna element 51 having a dual linear polarization configuration. Much of the structure and operation of antenna element 51 is similar to that of antenna element 1 and will not be repeated. Slot-dipole antenna element 51 includes cavity-backed slot antenna element 60 having an upper surface 67 and a lower surface 68. Lower surface 68 is preferably a ground plane. Upper surface 67 includes dual polarized, cavity-backed crossed slot 75 having two axes of magnetic polarization. Preferably slot 75 is a cross-shaped portion etched from upper surface 67 and having arms 75*a* and 75*b*.

Figure 6B:
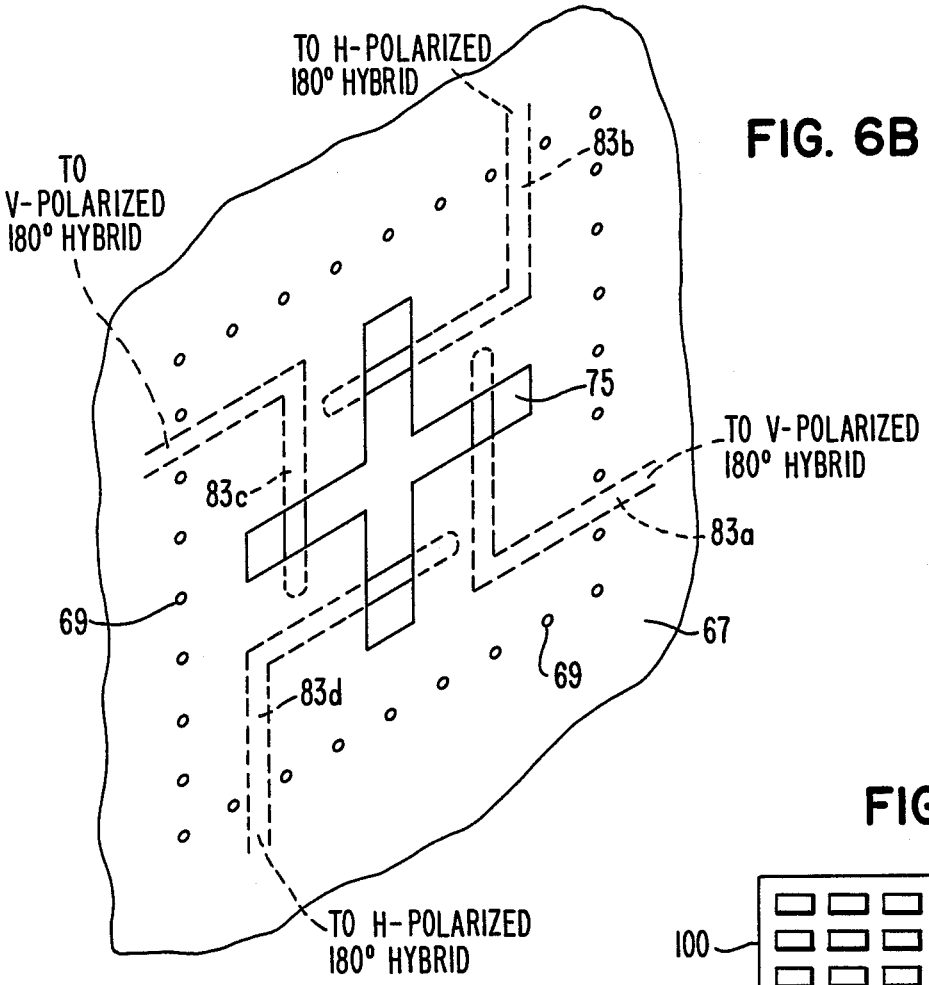
FIG. 6B shows one type of stripline feed for the antenna element in FIG. 6A.

Cavity-backed slot antenna element 60 is preferably stripline fed. One example of stripline connection is shown in detail in FIG. 6B. FIG. 6B illustrates striplines 83*a*, 83*b*, 83*c* and 83*d* coupled to the two arms 75*a* and 75*b* of slot 75. The striplines are connected to first and second excitation signals respectively, received, for example, from V-polarized or H-polarized 180° hybrid circuits coupled to arms of slot 75. The connection to the hybrid circuits is by stripline feeds 82, 84, 85 and 86, shown in FIG. 6A. The stripline excites slot 75 along first and second axes perpendicular to the arms. The first and second excitation signals may be either different or the same.

In the embodiment of the invention shown in FIG. 6A, cavity-backed slot antenna element 60 preferably includes two dielectric layers 61 and 62. Striplines 83*a*–83*d* would lie between layers 61 and 62. Layers 61 and 62 are preferably printed circuit boards with upper and lower surface etching similar to that explained in detail the description of the the embodiment of FIG. 1. For example, lower surface 68 of layer 62 may remain unetched while upper surface 67 of layer 61 has slot 75 etched from it. The lower surface of upper layer 61 would preferably have no conductive material and the upper surface of lower layer 62, would have conducting material only for striplines. Persons of ordinary skill in the art will recognize alternative construction techniques.

FIG. 6B shows holes 69 which are formed between surfaces 67 and 68 to form, along with those surfaces, a cavity. Holes 69 are omitted from FIG. 6A for simplification of the drawings. Preferably, holes 69 are plated and thereby electrically connect surfaces 67 and 68, but alternative electrical connections are also possible.

The dual polarization configuration of the complementary slot-dipole antenna element of this invention also includes a dual polarized parasitic dipole element having first and second electric field axes aligned with the axes of cavity-backed slot antenna element 60. One example of such an element is crossed-dipole element 70 which is selected so that the combination of elements 60 and 70 resonate along the first and second axes at approximately the center frequencies of the first and second excitation signals, respectively. As shown in FIG. 6A element 70 is preferably a crossed-dipole which is displaced a predetermined distance above the cavity-backed slot antenna element 60. The spacer sheets or other means for separation are omitted from FIG. 6A since these forms of separation can be equivalent to those used for the embodiment of the invention in FIG. 1.

Dipole element 70 could also be formed of printed circuit board material. For example the spacer sheet would include a printed circuit board with a completely etched lower surface and an upper surface onto which dipole element 70 is etched.

In operation, excitation signals from a source of such signals, such as a hybrid circuit, pass through striplines 83*a*–83*d* and excite slot 75 of the cavity-backed slot antenna element 60. The electric fields of slot 75 are parallel to the axes of parasitic crossed-dipole element 70, so that both antenna elements 60 and 70 are coupled and will radiate when either is driven. As with the embodiment of the invention shown in FIG. 1, the cavity in antenna element 60 ensures that the fields produced by slot 15 and dipole 70 radiate in only one direction.

Figure 7:
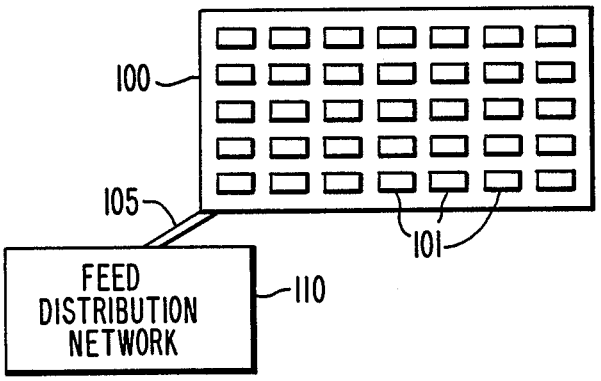
FIG. 7 is a schematic diagram of an array of parasitically-coupled, complementary slot dipole antenna elements of this invention.

FIG. 7 shows the antenna array according to the present invention. In FIG. 7, antenna array 100 includes elements 101. Each element 101 can be the antenna elements shown in FIG. 1 or FIGS. 6A and 6B, or can be any other antenna element according to the present invention.

Feed distribution network 110 supplies excitation signals to antenna elements 101 via feedlines 105. Antenna elements 101 are then connected to feed lines 105 and to each other in the manner desired to achieve the necessary array functioning. Such connections are conventional and need not be described here. For example, antenna array 100 could actually be a phased array used as a transmitter or receiver. For such phased array, the construction of feed distribution network 110 would be known to persons of ordinary skill in the art having knowledge of feed distribution networks for phased array and with knowledge of the antenna elements according to this invention.

FIG. 8 shows an enlarged portion of an array, such as array 100 in FIG. 7, of antenna elements in accordance with FIGS. 6A and 6B. The top layer includes a plurality of crossed dipoles 207 on a printed circuit substrate. The second layer 210 includes a printed circuit substrate and a top surface 212 including a matrix of crossed slots 211. The bottom layer 220 includes stripline feed 222 (the one shown is for S-Band excitation signals) and a ground plane 225. In addition plated holes 219 connect the top surface 212 and the ground plane 225. Exemplary values for the thicknesses of each layer are 0.062 inches for the top layer 205, and 0.125 inches for the second and third layers 210 and 220.

It will be apparent to those skilled in the art that modifications and variations can be made in the parasitically coupled-complementary slot-dipole antenna system of this invention. The invention, and its broader aspects, is not limited to the specific details, representative apparatus, and illustrative examples shown and described. Departure may be made from such details without departing from the spirit or scope of the general inventive concept.

What is claimed:

1. A parasitically coupled, complementary slot-dipole antenna element adapted to be coupled to a source of excitation signals having a center frequency, said antenna element comprising:

a driven, cavity-backed slot antenna element adapted to be coupled to said source of excitation signals, said cavity-based slot antenna element having a first axis and a slot with a longitudinal axis transverse to said first axis of said cavity-backed antenna element; and a parasitic dipole element displaced a selected distance from said cavity-backed slot antenna element and having a longitudinal axis which is parallel with said first axis of said cavity-backed slot antenna element for producing a relatively symmetrical electromagnetic signature of increased bandwidth, said parasitic dipole element and said cavity-backed slot antenna element resonating approximately at said center frequency.

2. The antenna element of claim 1 wherein said driven, cavity-backed slot antenna element is dielectric filled.

3. The antenna element of claim 1 wherein said driven, cavity-backed slot antenna element is air filled.

4. The antenna element of claim 1 wherein said driven, cavity-backed slot antenna includes a stripline coupled to said source of excitation signals.

5. The antenna element of claim 1 wherein said selected distance between said driven, cavity-backed slot antenna element and said parasitic dipole element is approximately 0.125 times the wavelength at said center frequency.

6. The antenna element of claim 1 wherein said cavity-backed slot antenna element includes two layers of teflon-glass substrate.

7. The antenna element of claim 6 wherein said two layers of said teflon-glass substrate are each approximately 0.3 inches thick.

8. The antenna element of claim 1 wherein said driven, cavity-backed antenna element has both a top and bottom layer and a conducting sheet at each said top and bottom layer, and wherein said conductive sheet at said top layer is removed at said slot.

9. The antenna element of claim 8 wherein said driven, cavity-backed antenna element includes a dielectric printed circuit board substrate and a stripline through said substrate and coupled to said source of excitation signals, and wherein said conductive sheets are copper.

10. The antenna element of claim 9 wherein said dielectric printed circuit board substrate includes a first layer of teflon-glass substrate above said stripline and a second layer of teflon-glass substrate below said stripline.

11. The antenna element of claim 8 wherein said conductive sheets are electrically connected.

12. The antenna element of claim 11 wherein said driven, cavity-backed antenna includes a plurality of electrical connections between said conducting sheets at said top and bottom layers.

13. The antenna element of claim 12 wherein said electrical connections include a plurality of plated holes.

14. The antenna element of claim 1 further including a spacer sheet mounted between said cavity-backed slot antenna element and said parasitic dipole element to hold said parasitic dipole element said selected distance from said cavity-backed slot antenna element.

15. The antenna element of claim 14 wherein said spacer sheet includes a layer of foam.

16. The antenna element of claim 14 wherein said spacer sheet includes a layer of honeycomb material.

17. The antenna element of claim 14 wherein said spacer sheet includes a printed circuit board and wherein said parasitic dipole element comprises a metallic strip mounted on said printed circuit board.

18. The antenna element of claim 17 wherein said metallic strip is copper.

19. The antenna element of claim 1 further including a multi-layer printed circuit board, wherein said cavity-backed slot antenna element includes first and second printed circuit layers, with said first printed circuit layer being aligned on top of said second printed circuit layer, and a stripline between said first and second layers, said first printed circuit layer having a conducting sheet at a top surface, said second layer having a conducting sheet at a bottom surface, and said slot including an etched portion of said conducting sheet of said first layer, and wherein said parasitic dipole element includes a third printed circuit board layer on top of said first layer, and a conducting strip on a top surface of said third printed circuit board layer.

20. A parasitically coupled, complementary slot-dipole antenna element coupled to a source of first and second excitation signals having first and second center frequencies, said antenna comprising:

a driven, cavity-backed slot antenna element including a slot having two major magnetic field axes, said antenna element being coupled to said source of first and second excitation signals, said cavity and said slot antenna element being excited along said two axes by said first and second excitation signals, respectively; and a dual polarized, parasitic dipole antenna displaced a predetermined distance from said cavity-backed slot antenna element, said parasitic dipole having two major electric field axes aligned with said two magnetic axes of said slot and, together with said slot, resonating at approximately said first and second center frequency along said first and second major axes of said antenna elements.

21. The antenna element of claim 20 wherein said dipole element and said slot are both cross-shaped.

22. The antenna element of claim 20 wherein said cavity-backed slot-dipole antenna element includes first and second layers of printed circuit board material, said first layer having an upper surface from which said slot is etched and a lower surface from which the conducting material has been removed, and said second layer including an upper surface from which said striplines are etched and a lower surface completely covered with conducting material.

23. The antenna element of claim 22 wherein said dipole antenna element includes a printed circuit board having an upper surface from which said dipole antenna element is etched and a lower surface without conducting material.

24. The antenna element of claim 22 including plated holes electrically contacting said first layer upper surface and said second layer lower surface.

25. An array of parasitically coupled, complementary slot dipole antenna elements adapted to be coupled to a feed distribution network generating excitation signals, each said complementary slot dipole antenna elements comprising:

a driven, cavity-backed slot antenna element adapted to be coupled to said excitation signals from said feed distribution network, said cavity-backed slot antenna element having a first axis and a slot with a longitudinal axis transverse to said first axis of said cavity-backed antenna element; and a parasitic dipole element displaced a selected distance from said cavity-backed slot antenna element and having a longitudinal axis which is parallel with said first axis of said cavity-backed slot antenna element, said array of parasitically coupled complementary slot dipole antenna elements producing a relatively symmetrical electromagnetic signature and having an increased bandwidth.

26. The antenna array of claim 25 wherein each of said complementary slot-dipole antenna elements includes a multi-layer printed circuit board, wherein said cavity-backed slot antenna element includes first and second printed circuit layers, with said first printed circuit layer being aligned on top of said second printed circuit layer, and a stripline lying between said first and second layers, said first printed circuit layer having a conducting sheet at a top surface, said second layer having a conducting sheet at a bottom surface, and said slot including an etched portion of said conducting sheet of said first layer, and wherein said parasitic dipole element includes a third printed circuit board layer on top of said first layer, and a conducting strip on a top surface of said third printed circuit board layer.

27. An array of parsitically coupled, complementary slot dipole antenna elements adapted to be coupled to a feed distribution network generating excitation signals, each said complementary slot-dipole antenna elements comprising:

a driven, cavity-backed slot antenna element having a slot with two major magnetic field axes, said antenna element adapted to being coupled to said source of first and second excitation signals, said cavity-backed slot antenna element being excited along said two axes of said slot by said first and second excitation signals, respectively; and a parasitic dipole antenna displaced a selected distance from said cavity-backed slot antenna element, said parasitic dipole element having two major electric field axes aligned with said two axes of said slot and, together with slot, resontating at approximately said first and second center frequencies along with said first and second major axes of said antenna elements.

28. The antenna array of claim 27 wherein each of said complementary slot-dipole antenna elements includes a multi-layer printed circuit board, wherein said cavity-backed slot antenna element includes first and second printed circuit layers with said first printed circuit layer being aligned on top of said second printed circuit layer and a stripline lying between said first and second layers, said first printed circuit layer having a conducting sheet at a top surface, said second layer having a conducting sheet at a bottom surface, and said slot including an etched portion in said conducting sheet of said first layer, and wherein said parasitic dipole element includes a third printed circuit board layer on top of said first layer, and a conducting strip on a top surface of said third printed circuit board layer.

29. A parasitically coupled, complementary slot-dipole antenna element adapted to be coupled to a source of excitation signals having a center frequency, said antenna element comprising:

a driven, cavity-backed slot antenna element adapted to be coupled to said source of excitation signals, said cavity-based slot antenna element having a first axis and a slot with a longitudinal axis transverse to said first axis of said cavity-backed antenna element; and a parasitic dipole element displaced a selected distance from said cavity-backed slot antenna element and having a longitudinal axis which is parallel with said first axis of said cavity-backed slot antenna element for producing a relatively symmetrical electromagnetic signature of increased bandwidth, said parasitic dipole element and said cavity-backed slot antenna element resonating approximately at said center frequency, said cavity-backed slot antenna element comprising a first printed circuit layer aligned on top of a second printed circuit layer, and a stripline between said first and second layers, said first printed circuit layer having a first conducting sheet as a top surface, said second layer having a second conducting sheet as a bottom surface, and said slot including an etched portion of said first conducting sheet, and said parasitic dipole element being disposed in a third layer on top of said first layer, and including a conducting strip on a top surface of said third layer.

30. The antenna element of claim 29 wherein said selected distance between said driven, cavity-backed slot antenna element and said parasitic dipole element is approximately 0.125 times the wavelength at said center frequency.

31. The antenna element of claim 29 wherein said first and second layers are formed of a teflon-glass substrate.

32. The antenna element of claim 29 wherein said first and second conducting sheets are formed of copper.

* * * * *